US006256943B1

(12) United States Patent
Mander et al.

(10) Patent No.: US 6,256,943 B1
(45) Date of Patent: Jul. 10, 2001

(54) ANTISEISMIC DEVICE FOR BUILDINGS AND WORKS OF ART

(75) Inventors: John B. Mander, Amherst; Gokhan Pekcan, Tonawanda; Stuart S. Chen, Amherst, all of NY (US)

(73) Assignee: The Research Foundation of SUNY at Buffalo, Amherst, NY (US)

( * ) Notice: Subject to any disclaimer, the term of this patent is extended or adjusted under 35 U.S.C. 154(b) by 0 days.

(21) Appl. No.: 09/409,267

(22) Filed: Sep. 30, 1999

Related U.S. Application Data

(63) Continuation-in-part of application No. 09/040,879, filed on Mar. 18, 1998, now abandoned.

(30) Foreign Application Priority Data

Mar. 19, 1997 (FR) ..... 97 03352

(51) Int. Cl.[7] ..... E04H 9/00

(52) U.S. Cl. ..... 52/167.1; 52/167.3; 52/167.8; 52/146; 52/152

(58) Field of Search ..... 52/167.3, 167.8, 52/148, 149, DIG. 11, 167.4, 152, 247, 146, 167.1

(56) References Cited

U.S. PATENT DOCUMENTS

| | | | | |
|---|---|---|---|---|
| 2,053,226 | | 9/1936 | Ruge . | |
| 2,193,380 | | 3/1940 | Price . | |
| 4,090,364 | | 5/1978 | Muller . | |
| 4,249,352 | * | 2/1981 | Marchaj | 52/167.1 |
| 4,577,826 | | 3/1986 | Bergstrom et al. . | |
| 4,860,507 | | 8/1989 | Garza-Tamez . | |
| 4,946,128 | | 8/1990 | Cunningham . | |
| 5,491,938 | | 2/1996 | Niwa et al. . | |
| 5,934,028 | * | 8/1999 | Taylor | 52/167.3 |

FOREIGN PATENT DOCUMENTS

| | | |
|---|---|---|
| 906 025 | 4/1987 | (BE) . |
| 7-034718 | 6/1995 | (JP) . |
| 9-025740 | 5/1997 | (JP) . |
| 9-041718 | 6/1997 | (JP) . |

* cited by examiner

*Primary Examiner*—Christopher T. Kent
*Assistant Examiner*—Jennifer I. Thissell
(74) *Attorney, Agent, or Firm*—Simpson, Simpson & Synder, L.L.P.

(57) ABSTRACT

An apparatus for mitigating seismic load imposing an overturning bending moment upon a multi-level structure comprises a tensioned tendon having a first end fixedly connected to one of the levels proximate one side of the structure and a second end fixedly secured to another of the levels proximate an opposite side of the structure, wherein the tendon is oriented in space between its first and second ends along a predetermined curve selected to provide optimum reaction to said load by running the tendon through intermediate story levels at calculated locations. The apparatus further comprises a supplemental system for connecting the second end of the tendon to the structure. The supplemental system preferably includes a mechanical energy dissipating device and a sacrificially yielding fuse element arranged in parallel with the mechanical energy dissipating device. The apparatus may be repeated in symmetrically opposite relation along chosen planes of the structure for protecting against seismic propagation along various directions.

10 Claims, 16 Drawing Sheets

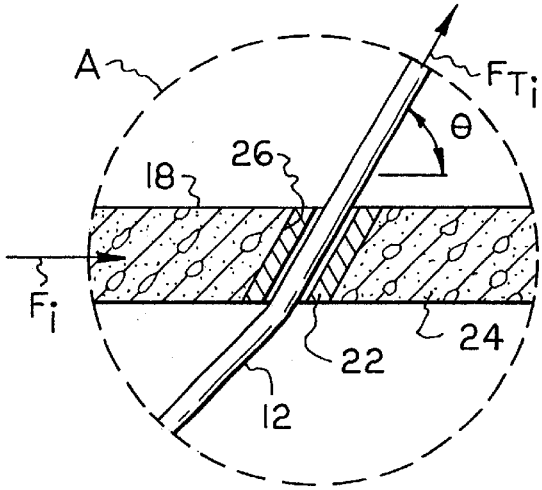
FIG. 9
FIG. 10
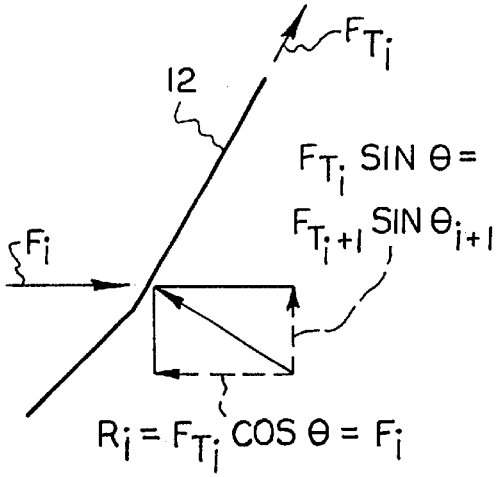
FIG. 11
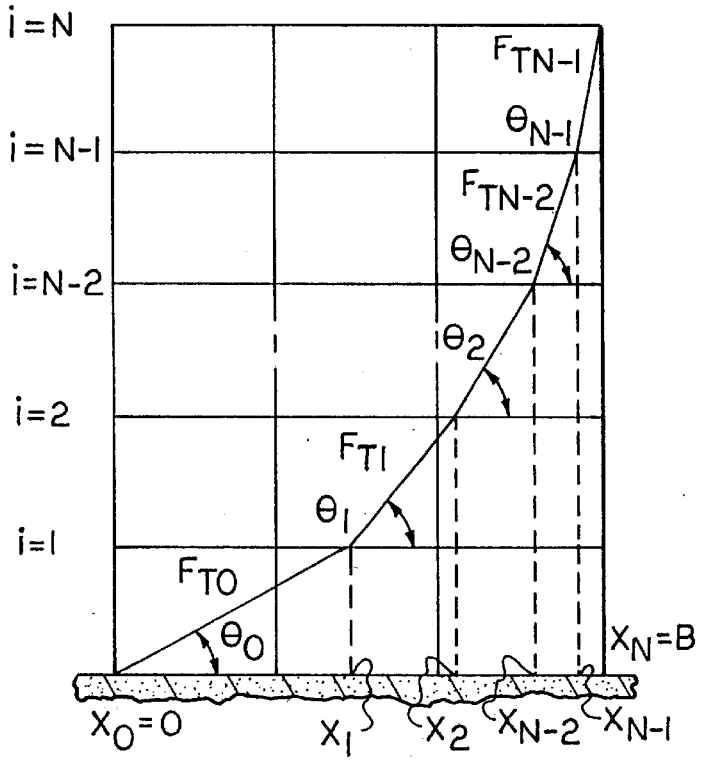

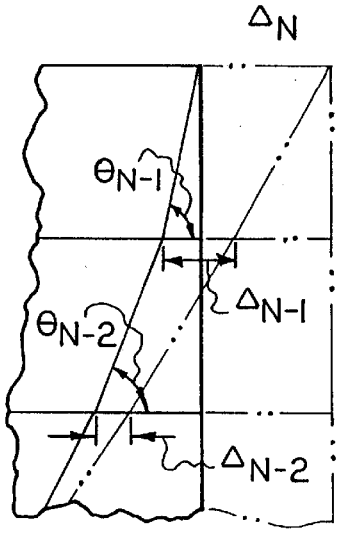
FIG. 12
FIG. 14
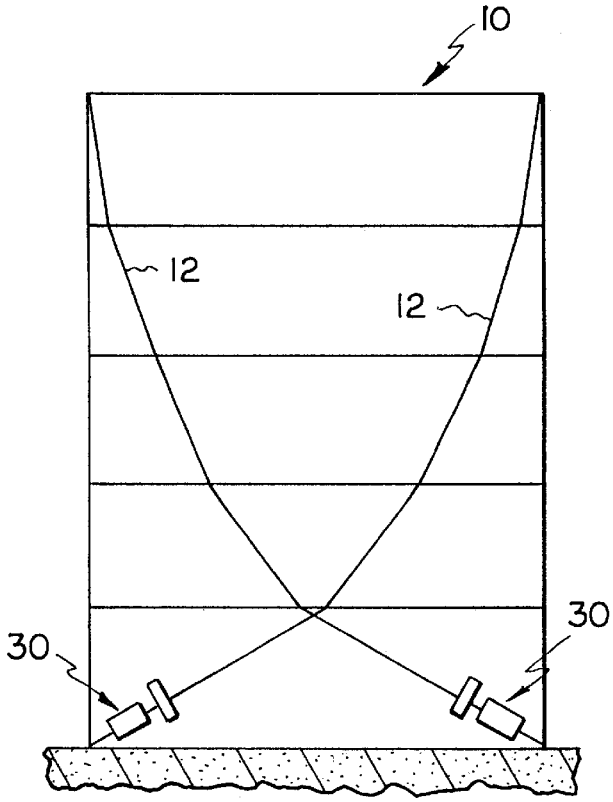
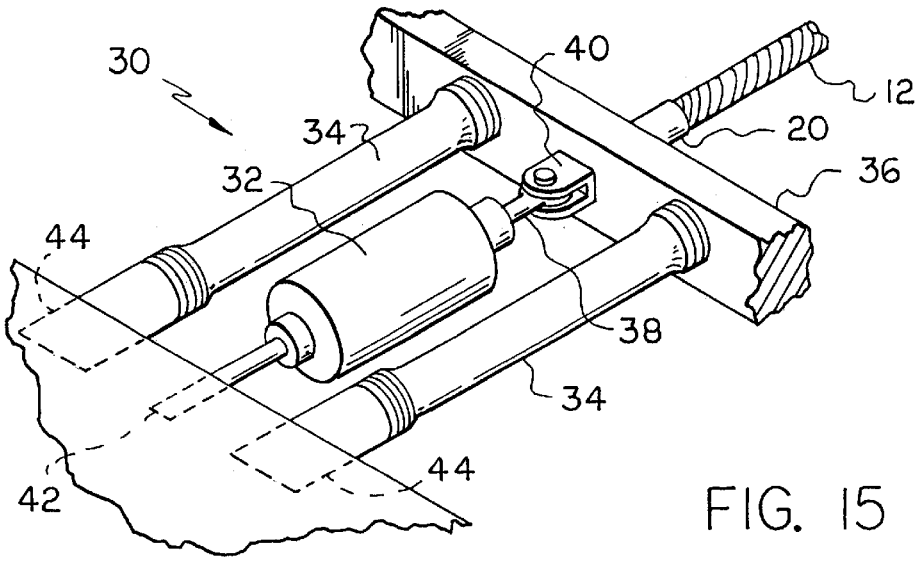
FIG. 15

ANTISEISMIC DEVICE FOR BUILDINGS AND WORKS OF ART

CROSS-REFERENCE TO RELATED APPLICATIONS

The present application is a continuation-in-part of application Ser. No. 09/040,879 filed Mar. 18, 1998, now abandoned.

BACKGROUND OF THE INVENTION

A. Field of Invention

The present invention relates generally to the field of earthquake safety systems for manmade structures, and more particularly to a method and apparatus for mitigating load imposed upon a structural frame using one or more tensioned tendons arranged in space to provide optimal reaction to the imposed lateral loads.

B. Description of the Prior Art

Ever since mankind began building structures to live and work in, the destructive power of earthquakes has been a looming threat to life and limb, especially in certain geographical regions, with the potential to flatten entire cities and cause thousands of deaths in a matter of seconds. In China, for example, extreme devastation occurred in the year 1556 when an earthquake is reported to have killed 830,000 people. Even in recent times, the death toll in China from earthquakes has been enormous. From 1920 to 1976, China has seen nearly 800,000 deaths from three earthquakes, and 650,000 of those were from a single earthquake in the city of Tangshan in 1976. Earthquake destruction is not confined to China. In Italy between 1908 and 1976, three earthquakes killed over 155,000 people. In Peru in 1970, a single earthquake killed 70,000 people. Japan has seen its share of disasters, with nearly 200,000 deaths being blamed on thirteen major earthquakes between 1891 and 1978. The 1995 Kobe earthquake in Japan killed nearly 5,500 people, injured 35,000 others, destroyed or badly damaged nearly 180,000 buildings, and caused damage totaling almost US $147 billion. In the United States, over 1,000 deaths have been attributed since 1906 to eight earthquakes, including the Loma Prieta earthquake in 1989 which claimed 68 lives in the San Francisco Bay area and caused over $20 billion in damage. In 1997, earthquakes were the cause of at least 2,980 deaths around the world.

Ironically, the earthquake itself, considered as the independent natural phenomenon of ground vibration, typically does not pose a threat to humans unless it causes major landslides or tidal waves. Rather, an earthquake typically becomes a dangerous force of nature when the ground vibration it creates interacts with manmade structures, causing gross deformation and structural failure thereof. Structural deformation during seismic excitation is due to forced displacement at the foundation, which results in oscillation and associated horizontal inertial loading on the structure. Because most structures are basically designed for gravitational loading, as opposed to earthquake-induced horizontally directed loading, an earthquake becomes a catastrophic event when structural failure occurs due to the inability of structures to withstand the forces caused by seismic excitation.

In the effort to neutralize the danger caused by collapsing structures during an earthquake, structural engineers have, over the past fifty years, made significant advances in the design of structures for resilience to earthquake excitation. As knowledge has accumulated in this field, it has become evident that in order for a structure to avoid collapse, it must be designed to absorb and dissipate the kinetic energy imparted to it by the earthquake. Modem earthquake-resistant design has basically followed three courses: 1) the design of structures with members able to passively dissipate significant amounts of energy through stable inelastic deformation, while sustaining limited amounts of damage; 2) the use of special energy-dissipating devices for limiting the degree of damage sustained by the structure; and 3) seismic isolation of structures in an attempt to control the amount of energy imparted to them by an earthquake. The advances made in these three areas are implemented not only in new constructions, but also in retrofitting of existing structures.

The oscillation and deformation of a building or other structure due to seismic excitation is a physical process during which kinetic energy is imparted to the structure in the form of elastic deformation. This energy alternates continuously from kinetic to potential (strain) energy during successive phases of oscillation of the structure, until it is ultimately dissipated as heat energy through the procedure of viscous and hysteretic damping. Thus, one of the main problems in designing an earthquake-resistant structure is to provide a structural system able to dissipate this kinetic energy through successive deformation cycles without exceeding certain damage limits. In other words, the building or structure must be able to translate large quantities of kinetic energy into deformations in the plastic range of the construction material. To accomplish this, structures are designed to passively resist earthquake damage through a combination of strength and deformability. The intent of this design approach is for a structure to behave elastically for low-intensity earthquakes, suffering no structural damage, to suffer some repairable damage from medium-intensity earthquakes, and to withstand high-intensity earthquakes without collapsing but suffering significant plastic deformations in critical regions of the structural elements. To achieve this, it is known to provide moment resisting frames, shear walls, concentric and eccentric braces, or a combination of these to increase lateral strength and avoid excessive floor displacement (interstory drift). Under high-intensity earthquakes, the shear walls are permitted to crack and yield, concentric braces are permitted to buckle, and eccentric brace shear links are designed to yield so as to reduce inertial forces during earthquake shaking. Seismically induced damage under moderate and high-intensity earthquakes is intended to occur in specially detailed critical regions of lateral force resisting systems, e.g. in the beams near the beam-column joints. Although this design philosophy gives structures improved ability to avoid collapse, it is untenable to some structural designers charged with designing hospitals, fire departments, and other critical facilities which must remain in operation following a strong earthquake.

The second design course mentioned above, namely use of special energy-dissipating devices, has involved four main groups of devices: friction devices which dissipate energy by way of metal to metal slippage contact, metallic damping devices which exploit reliable yielding properties of mild steel to go through numerous stable inelastic cycles, viscoelastic dampers made of bonded viscoelastic layers (acrylic polymers), and viscous fluid dampers which operate under principles of fluid flow through orifices.

The third conventional approach to the seismic design of structures, that is the base isolation approach, is based on the premise that it is feasible to "uncouple" a structure from the ground and thereby protect it from the damaging effects of earthquake motions. In dynamic terms, the goal is to lengthen the period of vibration of the total system beyond the predominant ground periods, thereby reducing the forced response in the structure. To achieve this result, flexible mounting of the structure is provided by the use of special bearing seats, such as elastomeric/rubber bearings or PTFE/friction sliding bearings, which are installed at the base of the structure between the foundation and the structure. However, the elastomers are subject to aging and sliding surfaces subject to wear, and may not be in a condition to react as intended by the designer at the time of an earthquake.

SUMMARY OF THE INVENTION

To overcome the shortcomings encountered in prior art approaches, the present invention adapts the load-balancing concept used in unbonded post-tensioned prestressed concrete structures. In conventional prestressed concrete (or steel) structures, prestressing cables/strands/tendons are passed through ducts that are cast into the concrete (or are positioned within preset locations), to balance the gravity loads along the structure. The resulting draped profile of the prestressing tendons, referred to as the "Center of Gravity of Steel," conforms closely to the profile of the bending moment diagram for gravity loading on the structure. In this way the gravity loads are said to be "balanced" by the effects of prestressing. The present invention takes this principle and applies it in a non-obvious way to balance the lateral loads that may arise from earthquake or wind effects on structures. Earthquake and wind loads are unlike gravity loads in that they are dynamic rather than static. Therefore, the apparatus of the present invention comprises two major components: post-tensioned prestressing tendons and a supplemental damping system including a mechanical energy dissipating device (hereinafter referred to as a MED device) and/or a sacrificial fuse element.

The tendons are draped in a plane from one side of the structure to an opposite side of the structure along a predetermined curve proportional to a bending moment distribution for the structure that is representative of the most adverse form of lateral load that may arise from earthquake and/or wind effects. An optimal tendon placement is determined using the structure's physical parameters, including overall height, width, number of levels, and height between levels, distribution of weight, to develop a force equilibrium equation based on inertial loads at each level, where the unknown in the equation is the optimum horizontal location of the tendon at that level to produce substantially equal and opposite reaction loads during an earthquake event. In rectangular structures, it is preferred to install a pair of symmetrically opposite tendons in each outer plane of the structural frame so as to mitigate seismic loading without regard to the direction of propagation of the seismic pulse. Unlike conventional prestressed structures that use tendons with a low axial stiffness to minimize the undesirable effects of long-term creep and shrinkage losses to the applied prestress force, the present invention employs tendons with a high axial stiffness to minimize the elastic shortening effects in the tendon that result from the transient nature of earthquake and wind loads. The inevitable transient movements that occur under earthquake and wind loads are mitigated either by movements in sacrificial fuse elements, or MED devices, or both. This action not only reduces the magnitude of earthquake- or wind-induced movements, but also attenuates the number of cycles of motion that could potentially damage the structure.

BRIEF DESCRIPTION OF THE DRAWINGS

FIG. 9 is an enlarged view of the circled portion A in FIG. 6 showing the tensioned tendon running through a story level guided by a sleeve;

FIG. 10 is a vector diagram showing load vectors acting on the guided portion of the tensioned tendon depicted in FIG. 9;

FIG. 11 is a schematic representation similar to that of FIG. 6, indicating further mathematical nomenclature used to describe the present invention;

FIG. 12 is a schematic detail view illustrating deformation of a portion of the multistory structure shown in FIG. 11;

FIG. 14 is a schematic representation similar to that of FIG. 6, however showing a pair of symmetrically opposite tensioned tendons installed in planar wall of a multistory structure in accordance with the present invention;

FIG. 15 is a perspective view showing a schematic of a MED device in parallel with a sacrificial metallic fuse element for connecting a tensioned tendon of the present invention to a structure;

DETAILED DESCRIPTION OF THE PREFERRED EMBODIMENTS

Figure 1C:
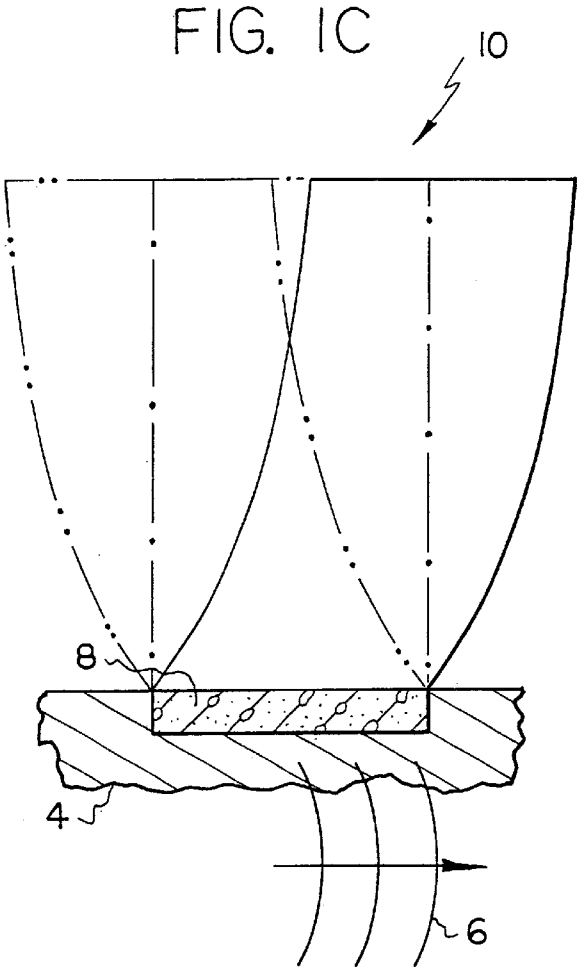
FIG. 1C is an exaggerated schematic representation of the structure shown in FIGS. 1A and 1B illustrating oscillatory motion of the structure resulting from the structural displacement illustrated in FIG. 1B.
Figure 1B:
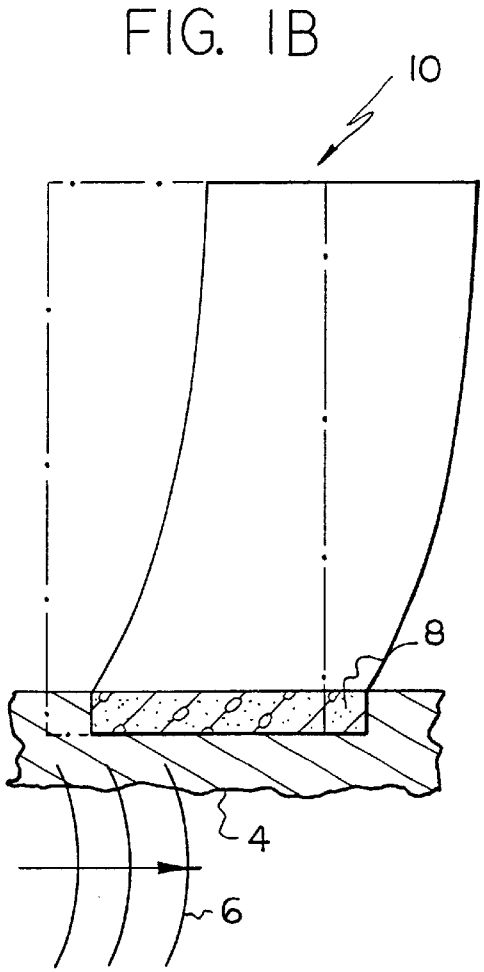
FIG. 1B is an exaggerated schematic representation of the structure shown in FIG. 1A illustrating structural displacement caused by the earthquake energy wave.
Figure 1A:
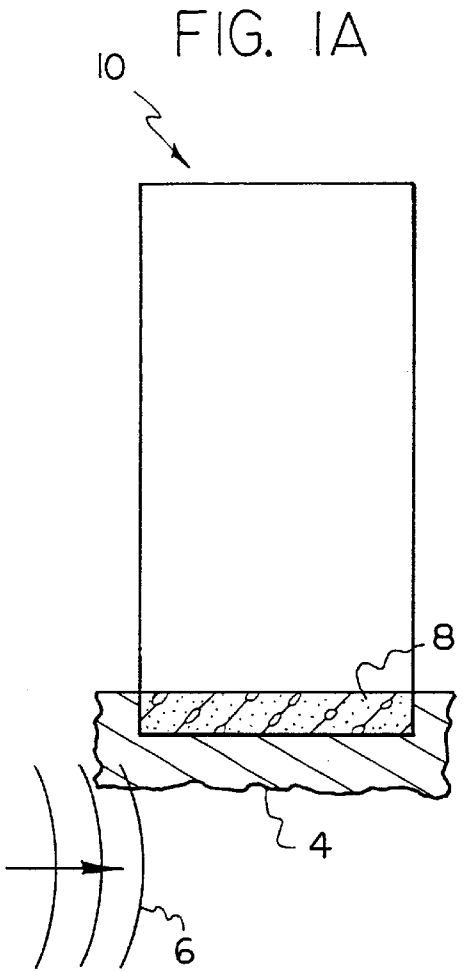
FIG. 1A is a schematic representation of a structure and its foundation about to be struck by an earthquake energy wave.

Referring first to the series of FIGS. 1A–1C, a seismic event and its effect on a structure, such as a building or work of art, are illustrated. In FIG. 1A there is shown a structure 10 built upon a subterranean foundation 8. The structure 10 and foundation 8 are shown in an initial resting position before they are impacted by an earthquake shock wave front 6 transmitted through the ground 4. FIG. 1B shows a lateral displacement of foundation 8 caused by earthquake shock wave 6. Finally, FIG. 1C illustrates resultant oscillation of an upper portion of structure 10 due to the lateral displacement of foundation 8 shown in FIG. 1B.

Figure 2:
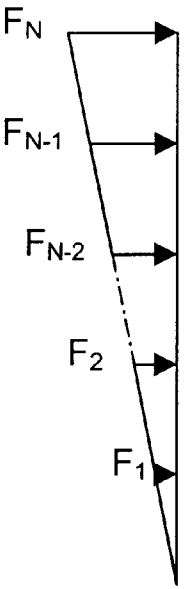
FIG. 2 is a diagram showing an inertial load distribution imposed upon the structure of FIGS. 1A–1C due to oscillation thereof.
Figure 3:
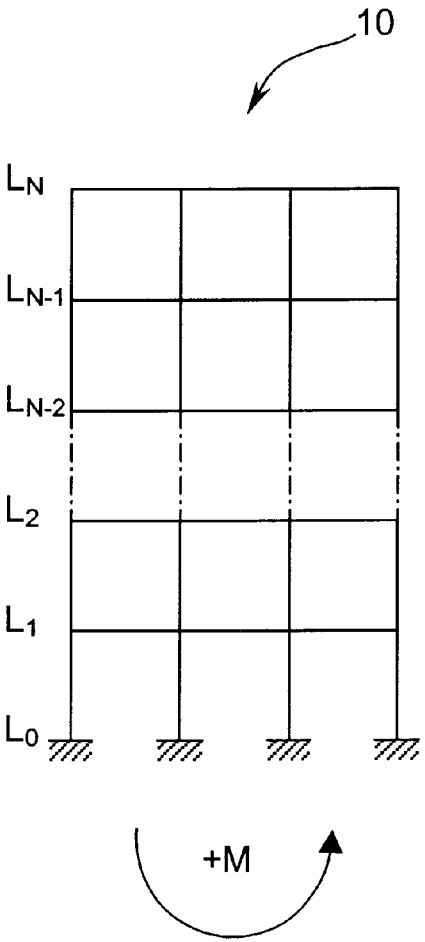
FIG. 3 is a schematic representation of a multistory structure having levels $L_0$ to $L_N$.
Figure 4:
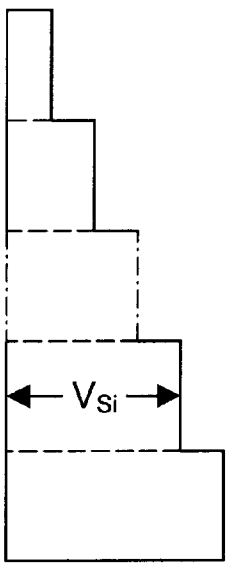
FIG. 4 is a diagram showing the resultant shear force distribution along the height of the structure shown in FIG. 3, assuming an inertial load distribution according to FIG. 2.
Figure 5:
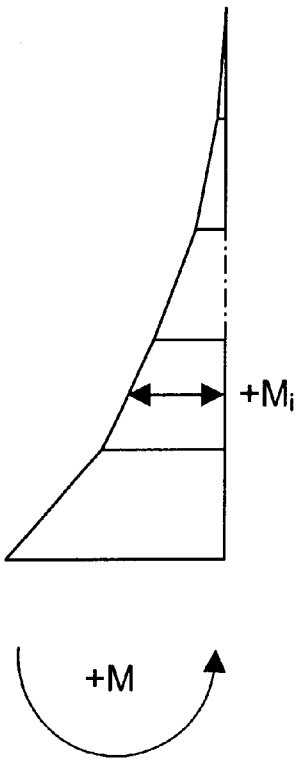
FIG. 5 is a diagram showing the resultant overturning bending moment distribution along the height of the structure shown in FIG. 3, assuming an inertial load distribution according to FIG. 2.

The seismic event with resultant oscillation imposes an inertial load distribution over the height of structure 10 as illustrated in FIG. 2, whereby inertial load increases substantially linearly with distance from the ground. It will be understood that the linear inertial load distribution of FIG. 2 is a typical loading profile where an earthquake shock wave is involved, however the application of the present invention is not limited solely to load distributions which are linear in shape. In fact, it is well known that load distribution depends in part upon the mode shapes which govern the overall seismic response of the structure. As indicated in FIG. 3, structure 10 comprises a plurality of levels $L_0, L_1, L_2, \ldots, L_N$, and is subject to an overturning bending moment M, defined as being positive in FIG. 3. Furthermore, assuming an inertial load distribution according to FIG. 2, the levels $L_0, L_1, L_2, \ldots, L_N$ of structure 10 experience respective shear forces $Vs_i$ for i=0 to N according to FIG. 4. The distribution of positive overturning bending moment +M imposed on structure 10 under the aforesaid conditions is depicted graphically by the curve in FIG. 5, with a moment $M_i$ corresponding to each respective level $L_i$ for i=0 to N. It will be evident to those skilled in the art that the shape of the shear force distribution shown in FIG. 4 and the shape of the overturning bending moment distribution shown in FIG. 5 are particular to the specific inertial loading distribution; as the inertial loading distribution varies, so do the resultant shear force and overturning bending moment distributions.

Figure 8:
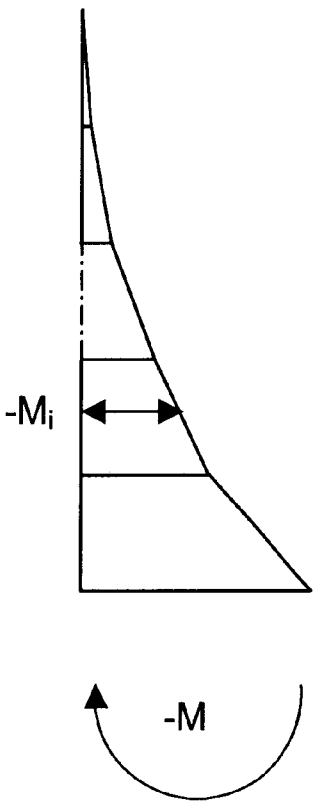
FIG. 8 is a diagram showing a reaction bending moment distribution along the height of the structure shown in FIG. 6 created by the tensioned tendon.
Figure 7:
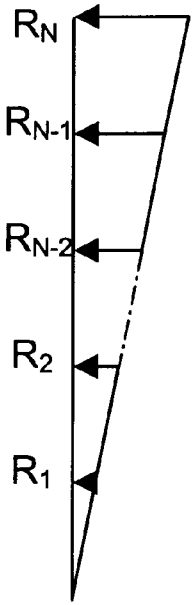
FIG. 7 is a diagram showing a reaction force distribution along the height of the structure shown in FIG. 6 created by the tensioned tendon.
Figure 6:
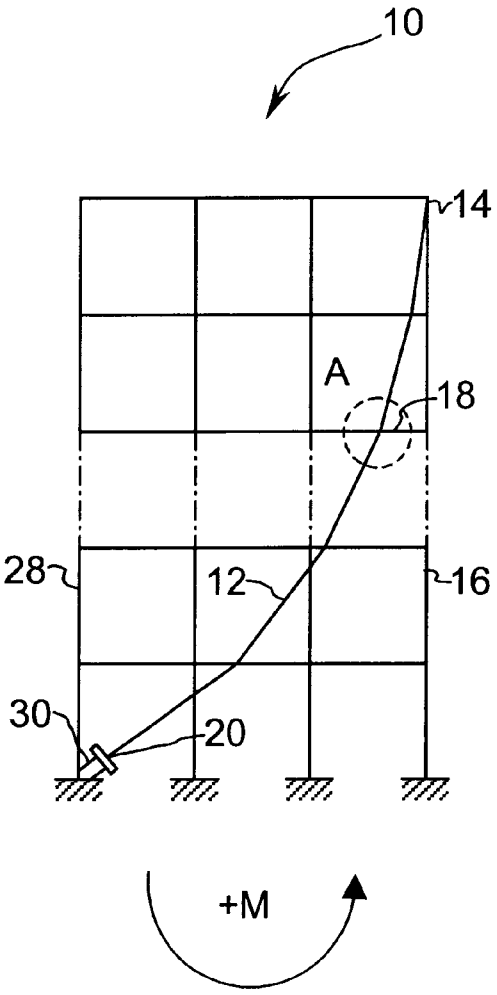
FIG. 6 is a view similar to FIG. 3, however showing one tensioned tendon installed in accordance with the present invention.

Attention is now directed to FIGS. 6–8. In accordance with the method and apparatus of the present invention, at least one prestressed tendon 12 is draped in an optimal layout within structure 10 so as to oppose the positive overturning bending moment +M when structure 10 oscillates due to seismic forces. Tendon 12 provides a horizontal reaction force distribution that is approximately equal in magnitude and opposite in direction to the inertial load distribution imposed upon structure 10, thereby creating a negative overturning bending moment −M to oppose the seismically induced positive overturning bending moment +M. Tendon 12 is arranged as shown in FIG. 6 to follow a curve that is directly proportional to the overturning bending moment M depicted graphically in FIG. 5. A first end 14 of tendon 12 is anchored to one level of structure 10, desirably but not exclusively a roof level $L_N$, proximate a first side 16 of the structure. Referring also now to the detail view of FIG. 9, tendon 12 is passed successively through each floor level 18 by running a second end 20 of the tendon through a sleeve 22 set in the flooring system/concrete slab 24 of the respective story floor 18. An inclined hole 26 is cast or bored through the flooring system/concrete slab 24 to receive corresponding sleeve 22, which is preferably lubricated to reduce friction between the sleeve and tendon 12 guided therethrough. The second end 20 of tendon 12 is fixedly connected to another level of structure 10, desirably but not exclusively a foundation level $L_0$, proximate a second side 28 of the structure. Second end 20 is preferably connected to level $L_0$ by way of a supplemental system 30 anchored to level $L_0$, as will be described below with reference to FIG. 14. Sleeves 22 are coplanar with each other so that tendon 12 resides in a single plane. The placement and incline of sleeves 22 is designed to provide a two-dimensional layout of tendon 12 from level $L_0$ to level $L_N$ that is approximately proportional to the overturning bending moment distribution shown in FIG. 5, with tendon 12 following straight line segments between adjacent levels. The installed tendon 12 is post-tensioned to produce a load $F_{Ti}$ as indicated in FIGS. 9 and 10. Post-tensioning of tendon 12 may be accomplished by a variety of means, but typically the tendon is connected to a tensioning jack mounted on the structure 10. Consequently, a tension force applied to tendon 12 induces a compressive force on structure 10 identical in magnitude to the tension force.

FIG. 10 offers a graphic analysis of the guided portion of tendon 12 shown in FIG. 9 to provide an understanding of the loading conditions acting at a node defined by the intersection of tendon 12 with the floor slab of a given level $L_i$ of structure 10, and FIGS. 11 and 12 illustrate adopted nomenclature for mathematical analysis. When structure 10 is caused to deflect so as to exert an inertial load $F_i$ against tendon 12, the tension force $F_{Ti}$ in prestressed tendon 12 produces a reaction force having a horizontal reaction force component $F_{Ti} \cos \Theta_i$ exerted by the tendon against sleeve 22 and the floor slab of story level $L_i$, where $\Theta_i$ is the angle between tendon 12 and story level $L_i$. Due to the optimal layout of prestressed tendon 12 determined by methodology described below, the horizontal reaction force distribution is approximately equal in magnitude and opposite in direction to the inertial load distribution imposed upon structure 10 according to FIG. 2. Consequently, a negative overturning bending moment −M is created to approximately oppose the seismically induced positive overturning bending moment +M, its distribution being shown in FIG. 8. In this way, the inertial loads and associated overturning bending moment imposed upon structure 10 are balanced.

Once the lateral design loads for structure 10 are determined according to known methodology, the geometry of the optimal tendon layout is determined. Horizontal force equilibrium at a node, shown in FIG. 10, may be written as follows by assuming rigid beam and column structural elements:

$$F_{T_i} \cos\Theta_i = \sum_{j=i+1}^{N} F_j \quad i = 0, \ldots, N-1$$

where $F_j$ is the horizontal lateral loading or story shear at level i. Vertical force equilibrium at each story level can be expressed $$F_{T_i} \sin \Theta_i = F_{T_{i+1}} \sin \Theta_{i+1} \quad i=0, \ldots, N-1$$

noting that the resultant force must equal zero. The vertical force equilibrium equation can be rewritten by pre-multiplying and dividing both sides by $\cos \Theta_i / \cos \Theta_{i+1}$:

$$\frac{F_{T_i} \cos\Theta_i}{F_{T_{i+1}} \cos\Theta_{i+1}} = \frac{h_{i+2}/(x_{i+2}-x_{i+1})}{h_{i+1}/(x_{i+1}-x_i)} = \frac{\tan\Theta_{i+1}}{\tan\Theta_i}$$

in which $h_{i+1}$ is the story height between levels $L_i$ and $L_{i+1}$. Substituting the horizontal force equilibrium equation in the above relation yields $$\frac{h_{i+1}}{h_{i+1}} \Psi_{i,i+1} = \frac{x_{i+1}-x_i}{x_{i+2}-x_{i+1}} \quad i=0, \ldots, N-2$$

where $\Psi_{i,\,i+1}$ is the ratio of the story shear at level $L_i$ to that at level $L_{i+1}$. This equation in fact defines a system of N−1 simultaneous equations with N−1 unknowns $x_i$:

$$x_0 - \left(\frac{h_1}{h_2}\Psi_{0,1}+1\right)x_1 + \frac{h_1}{h_2}\Psi_{0,1}x_2 = 0$$

$$x_1 - \left(\frac{h_2}{h_3}\Psi_{1,2}+1\right)x_2 + \frac{h_2}{h_3}\Psi_{1,2}x_3 = 0$$

$$\vdots$$

$$x_{N-3} - \left(\frac{h_{N-2}}{h_{N-1}}\Psi_{N-3,N-2}+1\right)x_{N-2} + \frac{h_{N-2}}{h_{N-1}}\Psi_{N-3,N-2}x_{N-1} = 0$$

$$x_{N-2} - \left(\frac{h_{N-1}}{h_N}\Psi_{N-2,N-1}+1\right)x_{N-1} = x_N$$

where $x_0=0$ and $x_N=B$, the width of the structural frame. Finally, the tendon layout is determined by solving the tri-diagonal matrix equation defined by the preceding system of simultaneous equations. Assuming equal story heights (i.e. $h_i=h_{i+1}$):

$$[\Psi]\{X\}=\{D\}$$

where $[R]$ =

$$\begin{bmatrix} -(\Psi_{0,1}+1) & \Psi_{0,1} & 0 & & & \\ 1 & -(\Psi_{1,2}+1) & \Psi_{1,2} & & [0] & \\ & 1 & -(\Psi_{2,3}+1) & \Psi_{2,3} & & \\ & & & \ddots & & \\ & [0] & & 1 & -(\Psi_{N-3,N-2}+1) & \Psi_{N-3,N-2} \\ & & & & 1 & -(\Psi_{N-2,N-1}+1) \end{bmatrix}_{N-1,N-1}$$

is the characteristic vertical load distribution matrix, $\{X\}^T=\{x_1, x_2, \ldots, x_{N-1}\}$ is the unknown column vector of tendon coordinates, and $\{D\}^T=\{0,0, \ldots, B\}$.

The above derivation may be performed assuming pseudo-static conditions of the structural frame. Since the lateral deformations will only cause small angle changes, the lateral force distribution will in fact remain unchanged. It is evident that the draped tendon layout provides an optimum lateral load balancing damping force distribution.

Further with respect to preferred apparatus of the present invention, a supplemental system 30 is anchored to foundation level $L_0$, or another chosen structural level, for providing a connection between the second end 20 of tendon 12 and the structure as shown in detail in FIG. 14 to increase the lateral stiffness of the structure. Supplemental system 30 is illustrated as generally comprising a MED device 32 and a sacrificial fuse element 34 arranged in parallel relation to each other. Both MED device 32 and sacrificial fuse element 34 are arranged in series with tendon 12 by way of a rigid beam 36 to which the second end 20 of tendon 12 is attached, with the point of connection of tendon 12 to beam 36 located intermediate the points of connection of MED device 32 and sacrificial fuse element 34 to the beam. In practice, it is desirable to locate MED device 32 and sacrificial fuse element 34 close together within the same housing such that they act substantially along a line of action coincident with the point of connection of tendon 12, whereby MED device 32 is substantially aligned with tendon 12 after sacrificial fuse element 34 fails. MED device 32 can be a viscous damper, elastomeric spring damper, metallic damper, or other type of energy dissipating device preferably designed to have recentering characteristics. In FIG. 15, MED device 32 is illustrated as including an actuating rod 38 pivotally connected to beam 36 by a clevis mount 40 and an anchor portion 42 suitable for fixing to level $L_0$. Sacrificial yielding fuse element 34, which provides a high initial stiffness and limits displacement, is preferably formed of high strength metal and has a well-defined yield point. If fuse-bar 34 is pretensioned so it begins yielding at the onset of impulse loading, it contributes to energy dissipation, however the initial pretension in sacrificial fuse element 34 should not exceed the initial pre-load level, if any, of MED device 32. As can be understood, supplemental system 30 is designed to attenuate the response with a required amount of opposing force primarily before and when the seismic impulse hits structure 10. Although supplemental system 30 is described above as including both an MED device 32 and a fuse element 34, it is within the scope of the invention to limit the supplemental system to only an MED device 32 (without fuse element 34) or to only a fuse element 34 (without MED device 32).

The total cross-sectional area $A_i$ of tendon 12 is specified based on the total design capacity of supplemental system 30 according to the expression $$A_i = \frac{\dfrac{C_c^{sup} W_{eff}}{\cos\theta_0}}{f_{su}^t}$$

where $W_{eff}$ is the effective weight of structure 10 and $f_{su}^t$ is the ultimate strength of the tendon element 12.

Deformation of supplemental system 30 is determined in terms of the geometry of the tendon layout, interstory deformations, and axial forces in the tendons. Interstory deformation $\delta_{i+1}$ between levels $L_{i+1}$ and $L_i$ can be written as:

$$\delta_{i+1}=\Delta_{i+1}-\Delta_i \quad i=0,1, \ldots, N-1$$

where $\Delta_i$ equals the absolute displacement at level $L_i$ relative to ground. As can be seen from FIG. 12, deformation of supplemental system 30 at the foundation level $L_0$ can be written as the sum of all the tendon segment elongations assuming zero tendon stiffness and subtracting the sum of all the actual tendon elongations due to tendon loading $F_{Ti}$:

$$X_{sup} = \sum_{i=0}^{N-1} \left\{ \left[ \left[ \sqrt{1 - \left[ \left( \frac{\delta_{i+1}}{S_i} \right) \sin\Theta_i \right]^2} + (\delta_{i+1}/S_i)\cos\Theta_i \right] - 1 \right] S_i - \frac{F_{T_i} S_i}{A_i E_i} \right\}$$

where $A_i$ is the tendon cross-sectional area, $E_i$ is Young's Modulus, and $S_i = h_{i+1}|\sin\Theta_i$ is the length of the tendon segment running between levels $L_i$ and $L_{i+1}$.

Figure 13:
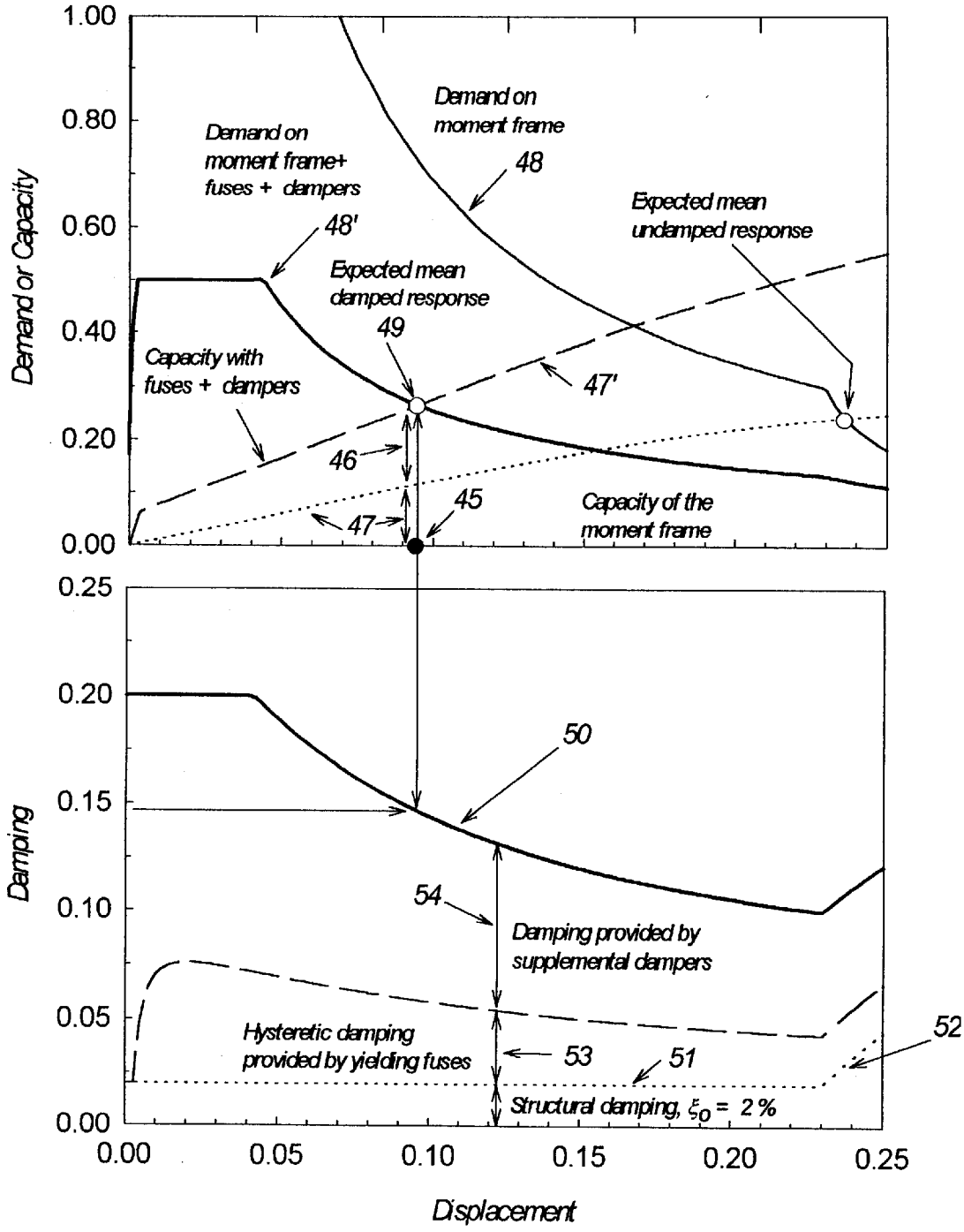
FIG. 13 is a graph illustrating preliminary design parameters for a supplemental system of the present invention.

Referring to FIG. 13, in a preliminary design phase, the normalized design capacity of the supplemental system is quantified based on the design ground motion along with a target design response that sets the performance objective which is typically a prescribed maximum roof displacement $X_{max}$ 45 during the design ground motion. An iterative preliminary design is carried out to determine the normalized supplemental system capacity $C_c^{sup}$ 46 for the deficiency between the structural capacity $C_c^{str}$ 47 of the bare frame of structure 10 and imposed ground motion demand $C_d$ 48, 48' on the structural system. Supplemental system capacity $C_c^{sup}$ is expressed as:

$$C_c^{sup} = C_d - C_c^{str}$$

Structural capacity $C_c^{str}$ 47 is determined using what is known as pushover analysis by plotting total base shear at the foundation level of structure 10 versus the corresponding roof displacement. In general, expected structural response occurs at the point of intersection 49 of the total capacity curve 47' (sum of capacity of the bare structure and that of supplemental system) with the reduced demand curve 48'.

First, a total effective damping $\zeta_{eff}^{total}$ 50 is assumed and ground motion demand $C_d$ 48, 48' is given by:

$$C_d = \frac{2.5\, C_a}{B_s} \le \frac{C_v^2 g}{4\pi^2 B_l^2 X_{\max}}$$

where $C_\alpha$ is the effective peak ground acceleration and $C_v$ is the effective peak ground velocity associated with the design ground motion, $B_s$ and $B_l$ are the demand reduction factors for higher damping to account for effect of the damping on the demand $C_d$ 48 for the short and long period ranges respectively. An effective period of vibration $T_e$ is then calculated as:

$$T_e = 2\pi \sqrt{\frac{X_{\max}}{g C_d}}$$

Various components of total effective damping within the structural system 10 are then identified as a function of effective period and demand, and total effective damping is calculated as the sum of inherent structural damping $\zeta_o$ 51, damping due to yielding structure $\zeta_{hy}^{str}$ 52 (if any), damping due to yielding of fuse-bars $\zeta_{hy}^{f}$ 53 and damping due to dampers $\zeta_d$ 54:

$$\zeta_{eff}^{total} = \zeta_o + \zeta_{hy}^{str} + \zeta_{hy}^{f} + \zeta_d$$

Using this calculated total effective damping $\zeta_{eff}^{total}$, demand reduction factors $B_s$ and $B_l$, hence ground motion demand $C_d$ 48' are recalculated and the process is repeated until the calculated total effective damping is reasonably close to its previous value. Finally, $C_d$ 48' is determined and is used to calculate required supplemental system capacity $C_c^{sup}$ 46.

MED device design, for example an elastomeric spring damper design, involves determining the damper force capacity requirement $c_\alpha$, the damper preload $P_y$, and the elastomeric stiffness $K_2$ for damper 32. Required damper force capacity is based on the required normalized damper capacity $C_c^d = r_d C_c^{sup}$, where $r_d$ is the proportion of the total load on supplemental system 30 carried by damper 32 (as opposed to fuse-bar 34) and $C_C^{sup}$ is the capacity of supplemental system 30, with correction being made for tendon layout inclination angle at the foundation level $L_0$ and for structural velocities as follows:

$$c_\alpha = \left( \frac{C_c^d W_{eff}}{\dot{x}_{ref}^\alpha} \right) \frac{1}{\left( \frac{2\pi}{T_{eff}} X_{sup} \right)^\alpha \left( \frac{T_{eff}}{0.75} \right)^{0.15\alpha}}$$

in which $\alpha$ is the damper exponent, $\dot{x}_{ref}$ is the damper testing velocity (commonly 1 m/s or 2 m/s), and $T_{eff}$ is the effective period of vibration of structure 10.

Turning now to the design of sacrificial fuse element 34, the maximum force $F_{maxf}$ and corresponding ultimate strength $F_{fu}$ of the fuse-bar are given by the following relations:

$$F_{\max,f} = \frac{(1 - r_d) C_c^{sup} W_{eff}}{\cos\Theta_0}$$

$$F_{fu} = 1.2\, F_{\max,f}$$

Fuse design includes choosing Young's Modulus $E_f$, ultimate strength $f_{su}$, yield strength $f_y$, strain at yield $\epsilon_y$, and ultimate strain $\epsilon_u$. The required cross-sectional area $A_f$ of sacrificial fuse element 34 is then calculated:

$$A_f = \frac{F_{fu}}{f_{su}}$$

Accordingly, the corresponding fuse diameter $d_f$ is given by $$d_f = \sqrt{\frac{4A_f}{\pi}}$$

and the fuse length $l_f$ can be calculated $$l_f = \frac{X_{sup}}{\varepsilon_u}$$

to provide the required fuse element specifications.

It is recognized that near-source ground motions may be detrimental for tall, flexible structures due to high initial pulse in the ground acceleration history. Excessive deformations, hence most of the yielding, tends to concentrate in the lower levels of framed structures. The method and apparatus of the present invention offer a viable solution by providing a system whose stiffness is controllable due to fuse element 34 in such a way that the required amount of opposing force is induced in the system only before and when the seismic impulse hits the structure. The sacrificial yielding fuse element 34 is used in parallel with MED device 32 to provide a high initial stiffness and limit displacements, while MED device 32 is effective to attenuate the remainder of the response after the fuse element yields. In this regard, it should be emphasized that the initial prestress in tendon 12 should not exceed the initial pre-load level in supplemental system 30.

Figure 17:
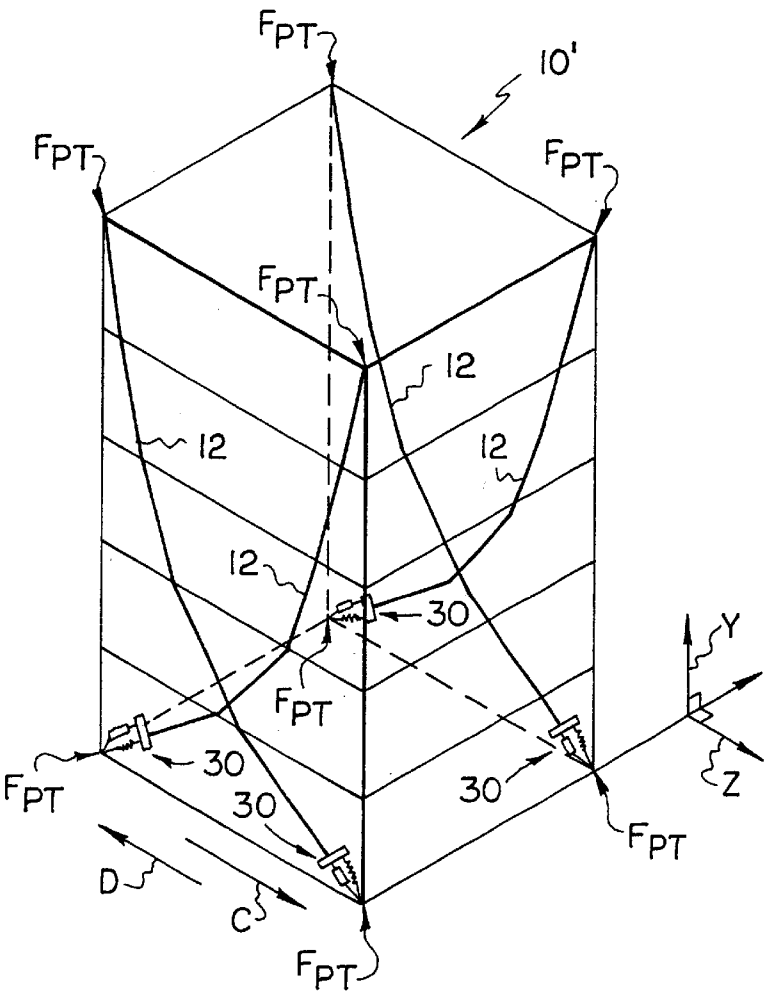
FIGS. 16 and 17 are schematic perspective views each showing two pairs of symmetrically opposite tensioned tendons installed in opposing planar walls of a multistory structure in accordance with the present invention, with the opposing walls in one view being orthogonal relative to the opposing walls in the other view, such depiction being necessary for the sake of clarity.
Figure 16:
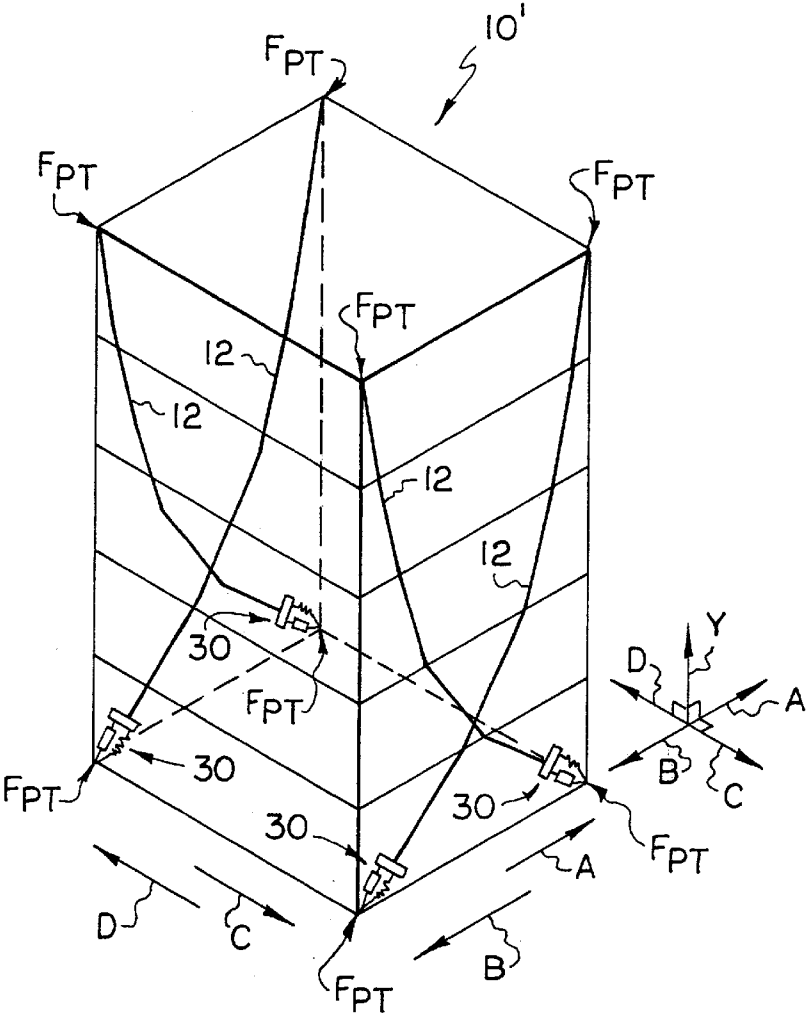

To this point, detailed description has been given with regard to a single tendon 12 in series with a supplemental damping system 30. As may be seen in FIGS. 14 and 16–19, the basic apparatus of the present invention is preferably repeated within a given structure for best results. FIG. 14 shows a pair of tendons 12 symmetrically arranged within a single wall. In this arrangement, the tendon layout coordinates for the second tendon are the same as for the first tendon, except they are measured from the opposite side of the wall. If each tendon 12 is stressed, for example to fifty percent of the yield stress of respective fuse-bars 34, then the initial stiffness is doubled, as both tendons will act together to double the effectiveness of the system. The pair of tendons will continue to work together until the tendon on the compression side becomes slack. This relaxes the structure and as the composite system is more flexible, the demand is reduced. In a preferred installation in a rectangular structure 10', each of the structure's four outer walls will contain two symmetrically opposite tendons 12, as shown separately in FIGS. 16 and 17 for sake of clarity. Thus, with all four walls constructed or retrofitted in accordance with the present invention, structure 10' is protected in all directions, even where the seismic impulse does not travel along a direction normal to a wall surface.

Figure 18:
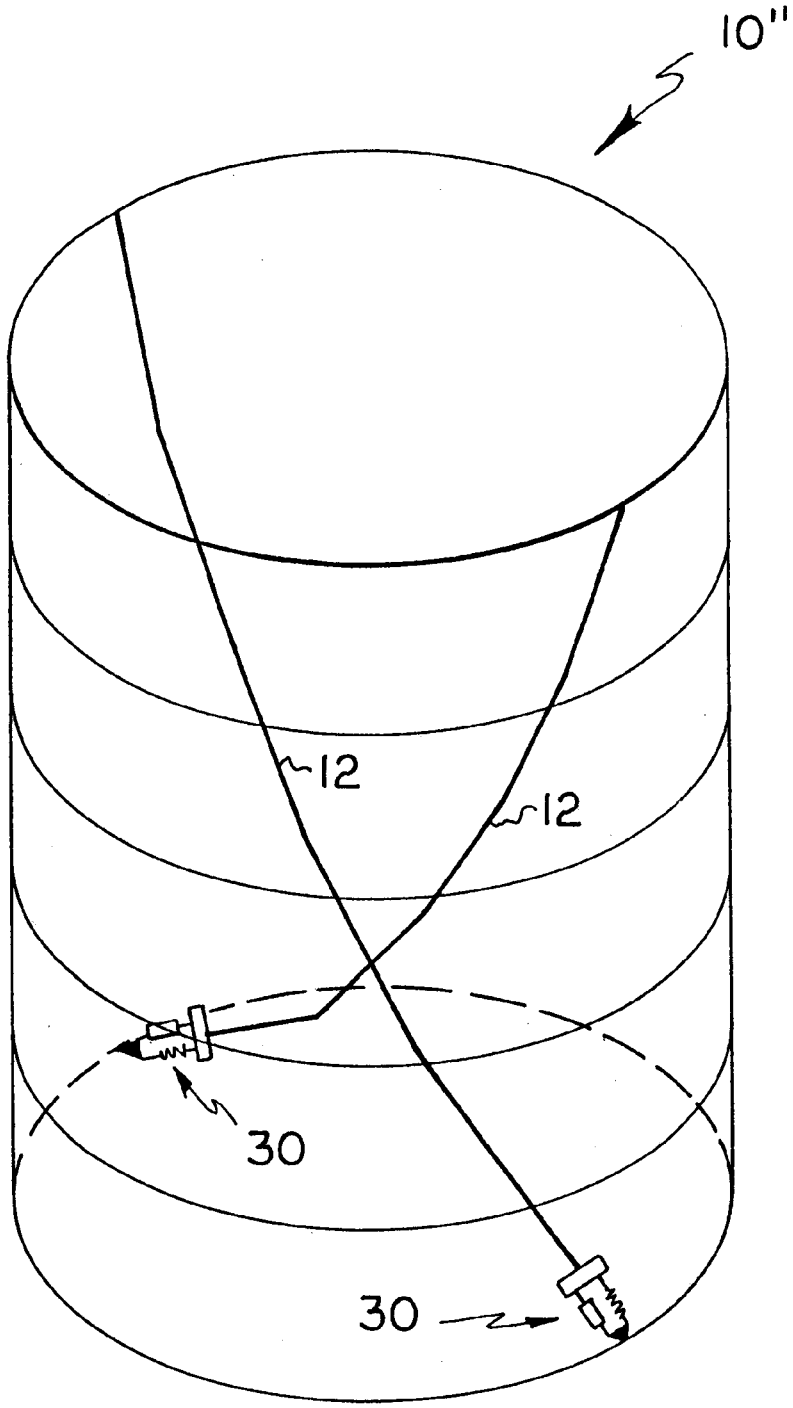
FIG. 18 is a schematic perspective view showing a pair of symmetrically opposite tensioned tendons installed in a multistory structure having a circular floor plan in accordance with the present invention.
Figure 19:
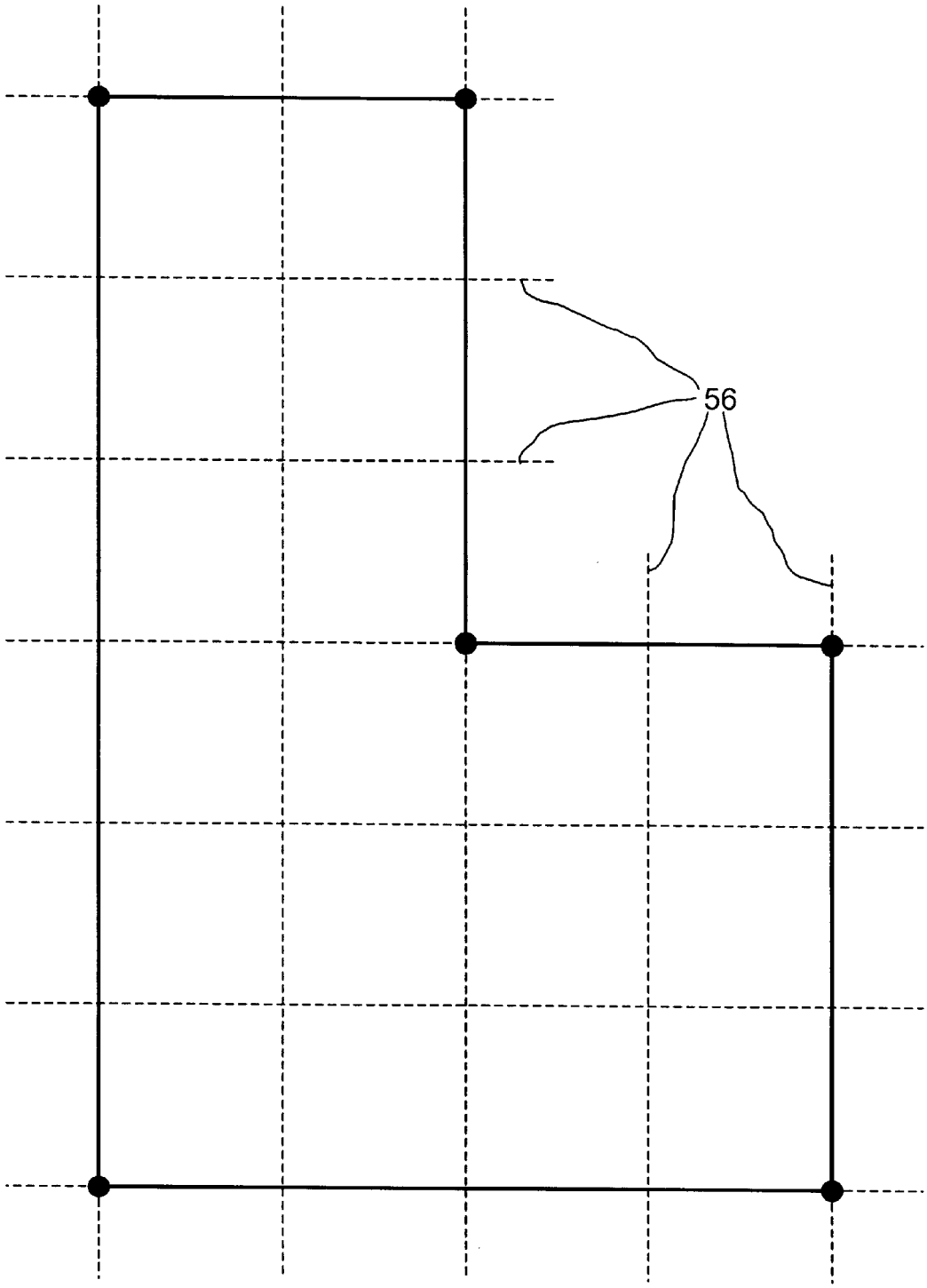
FIG. 19 is a plan view of a multistory structure having an L-shaped floor plan showing the planes wherein pairs of symmetrically opposite tensioned tendons could potentially be installed in accordance with the present invention.

The above description of the invention in connection with a rectangular structure is not meant to limit the invention to only rectangular structures, nor is it intended to limit the invention to outer structural walls. It is apparent that the present invention can be applied to structures of any shape, including a structure 10" with a circular footprint as shown in FIG. 18, and a structure 10''' with an L-shaped footprint as shown in FIG. 19. In FIG. 19, dashed lines 56 indicate structural frame planes in which pairs of tendons 12 can be located. In all cases, the number of prestressed tendons 12 and their placement will depend upon the specific geometry of the structure and designer discretion.

Example Retrofit Design of a Nine-Story Steel Building

The building considered for the verification of the apparatus and design methodology of the present invention is an existing nine-story steel building with a square plan and two axes of symmetry. Moment resisting frames exist on the perimeter only with pre-1994 (pre-Northridge earthquake) welded moment connections and all interior beam-column connections are simple connections. The building is located in the Los Angeles region, and according to NEHRP Seismic Hazard maps the effective peak acceleration coefficient is $C_\alpha$=0.4 and effective velocity coefficient is $C_v$=0.4. Recently, Naeim et al. (1998, "Effects of Hysteretic Deterioration Characteristics on Seismic Response of Moment Resisting Structures." Report on Task 5.4.4 of System Performance Investigation of SAC Joint Venture, JAMA Rep. 98/8428.58, John A. Martin & Associates, Inc., Los Angeles) have conducted numerous analytical studies on this building to establish a statistical database regarding the effects of hysteretic deterioration on the seismic response.

Figure 20:
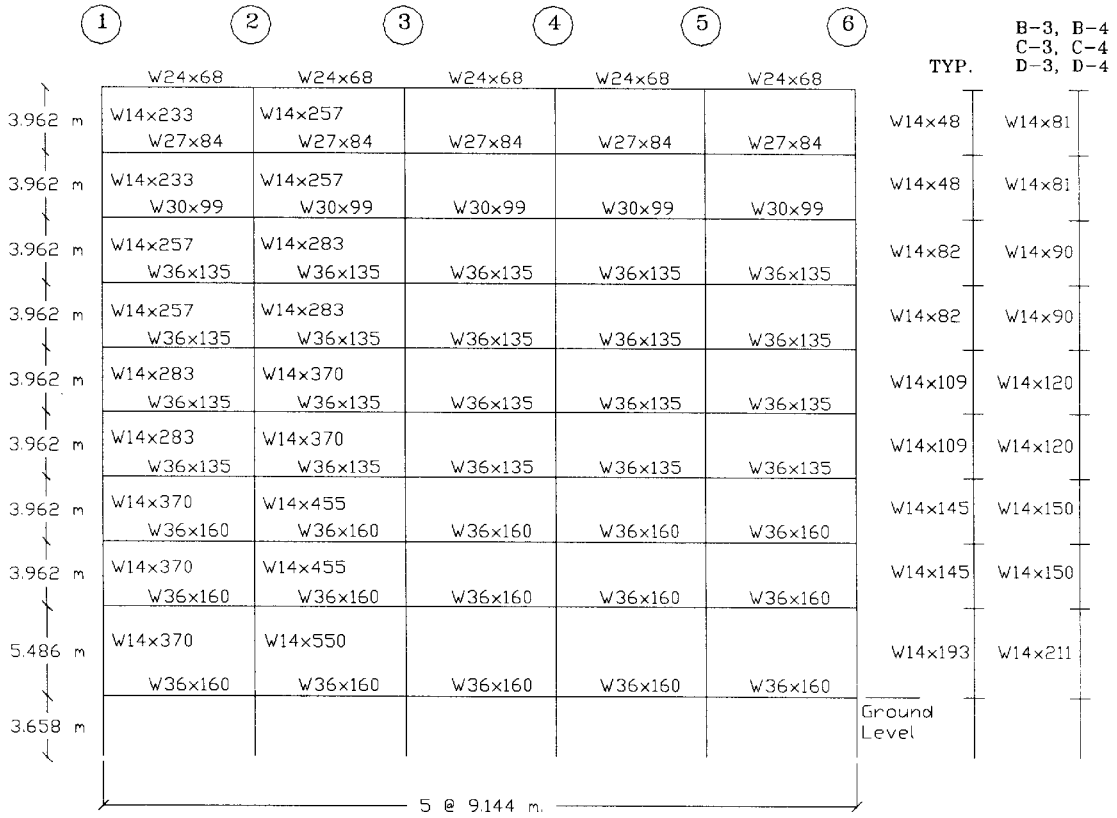
FIG. 20 is schematic diagram of an example nine-story structure.

Since the structural systems in two directions are essentially the same when viewed from the front and side elevations, only one direction is chosen for the present example as shown in FIG. 20. Furthermore, because of the symmetry, only the front half of the structure is modeled—one exterior moment frame and two interior gravity-load carrying frames. One-half of the total weight ($W_T$=89,395 kN including an allowance for live load) of the building is distributed to the horizontal degrees of freedom of the exterior frame. The building has one basement and that the ground floor is restrained laterally, therefore receives the same ground motion input as the column bases. It is for this reason that only the upper nine stories are considered in this example.

The general performance criteria adopted in this example are two: i) "no yielding" or essentially elastic response of the structural elements under the maximum assumed earthquake (MAE), and ii) up to 0.5% plastic hinge rotation at the beam-ends under the maximum considered earthquake (MCE). The latter requirement is based on the findings of many researchers who have studied the plastic hinge rotation capacity of typical pre-Northridge welded connections. The general performance based design objective is therefore to reduce the various response quantities but most importantly to control the interstory drifts so that plastic rotations at the beam-ends are within acceptable limits. This plastic hinge rotation criterion ($\theta_p$<0.005 rad) is therefore the most significant and challenging aspect of the retrofit design.

The combined structural system has a first mode-elastic period of 1.78 sec., and the inherent viscous damping ratio, $\zeta_o$=2% is assumed. Preliminary design carried out iteratively for damper–only ($r_f$=0) and damper+fuse design in which equal capacities are chosen ($r_f$=$r_d$=0.5). Table 1 summarizes the preliminary design parameters:

TABLE 1

Summary of Preliminary and Final Design Parameters for Dampers with Power, $\alpha$ = 0.2

| Parameter | (Units) | Damper only | Fuse + Damper |
|---|---|---|---|
| Preliminary Design: Target Roof Drift = 0.5% | | | |
| $\xi_{eff}^{total}$ | (%) | 18.8 | 16.2 |
| $B_s$ | — | 1.938 | 1.800 |
| $B_1$ | — | 1.487 | 1.423 |
| $C_d$ | (g) | 0.194 | 0.213 |
| $T_e$ | (sec) | 1.695 | 1.622 |
| $C_c^{str}$ | (g) | 0.145 | 0.145 |
| $C_c^{sup}$ | (g) | 0.050 | 0.070 |
| $C_c^{d}$ | (g) | 0.050 | 0.031 |
| $C_c^{f}$ | (g) | 0.0 | 0.031 |
| $\xi_d$ | (%) | 16.8 | 10.6 |
| $\xi_{hy}^{f}$ | (%) | 0.0 | 3.6 |
| $\xi_{eff}^{str}$ | (%) | 2.0 | 2.0 |
| Summary of PTFD Design Parameters | | | |
| $C_\alpha$ | (kN/(m/s)$^\alpha$) | 2,131 | 1,455 |
| $P_y$ | (kN) | 1,852 | 1,275 |
| $X_y$ | (m) | 0.003 | 0.003 |
| $K_2$ | (kN/m) | 30,000 | 30,000 |
| $X_{max}$ | (m) | 0.20 | 0.20 |
| Max. Force[1] | (kN) | — | 1,915 |
| Fuse Diameter | (mm) | — | 2 @50 |
| Fuse Length | (m) | — | 1.5 |
| Tendon Force | (kN) | 3,705 | 6,376 |
| Initial Prestress | (kN) | 925 | 1,145 |

[1]For the fuse + damper design, $r_d$ = $r_f$ = 0.5

Figure 21:
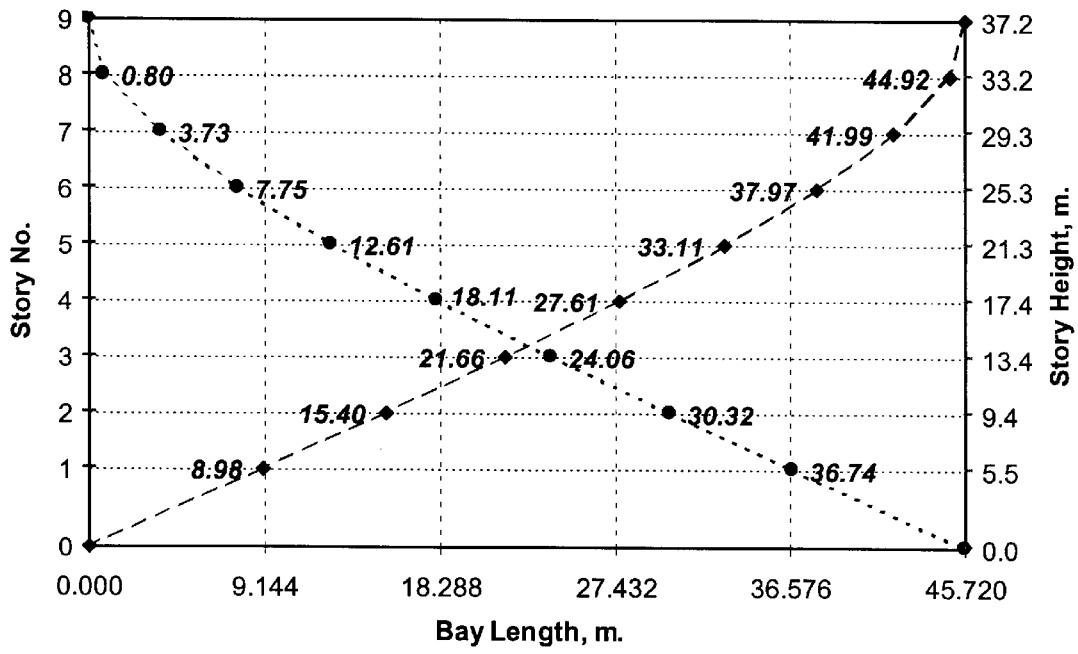
FIG. 21 is a plot showing calculated tendon layout for the example structure of FIG. 20.

Tendon layout is determined based on the overturning moments induced by a code-lateral force distribution assuming higher mode contributions (Federal Emergency Management Agency (FEMA), 1997, "NEHRP Guidelines for the Seismic Rehabilitation of Buildings." FEMA 273 (Guidelines) and 274 (Commentary), Washington, D.C.). The tendon layout is shown in FIG. 21. Based on this tendon geometry and calculated demand (Table 1), total supplemental system deformation is found to be 132 mm with the specific design values given in Table 1 for damper–only and damper+fuse designs.

The enhanced version of nonlinear time history analysis program DRAIN-2DX (Pekcan, 1998, "Design of Seismic Energy Dissipation Systems for Reinforced Concrete and Steel Structures." Ph.D. Dissertation, State University of New York at Buffalo, New York) was used to evaluate the performance of the example structure subjected to ground motions representative of MAE and MCE earthquakes. The following ground motions are used: 1940 El Centro SOOE, 1972 Taft S69E and 1994 Northridge—Arleta 90°. These ground motions were scaled to peak ground acceleration (PGA) of 0.4 g for the MAE. Three ground motions (scaled to PGA=0.60 g) that are representatives of the MCE are 1994 Northridge—Sylmar County Hospital (PGA=0.61 g), 1979 Imperial Valley—Array 5 (PGA=0.59) and 1995 Great Hanshin—Kobe Station (PGA=0.69) were used.

Figure 22:
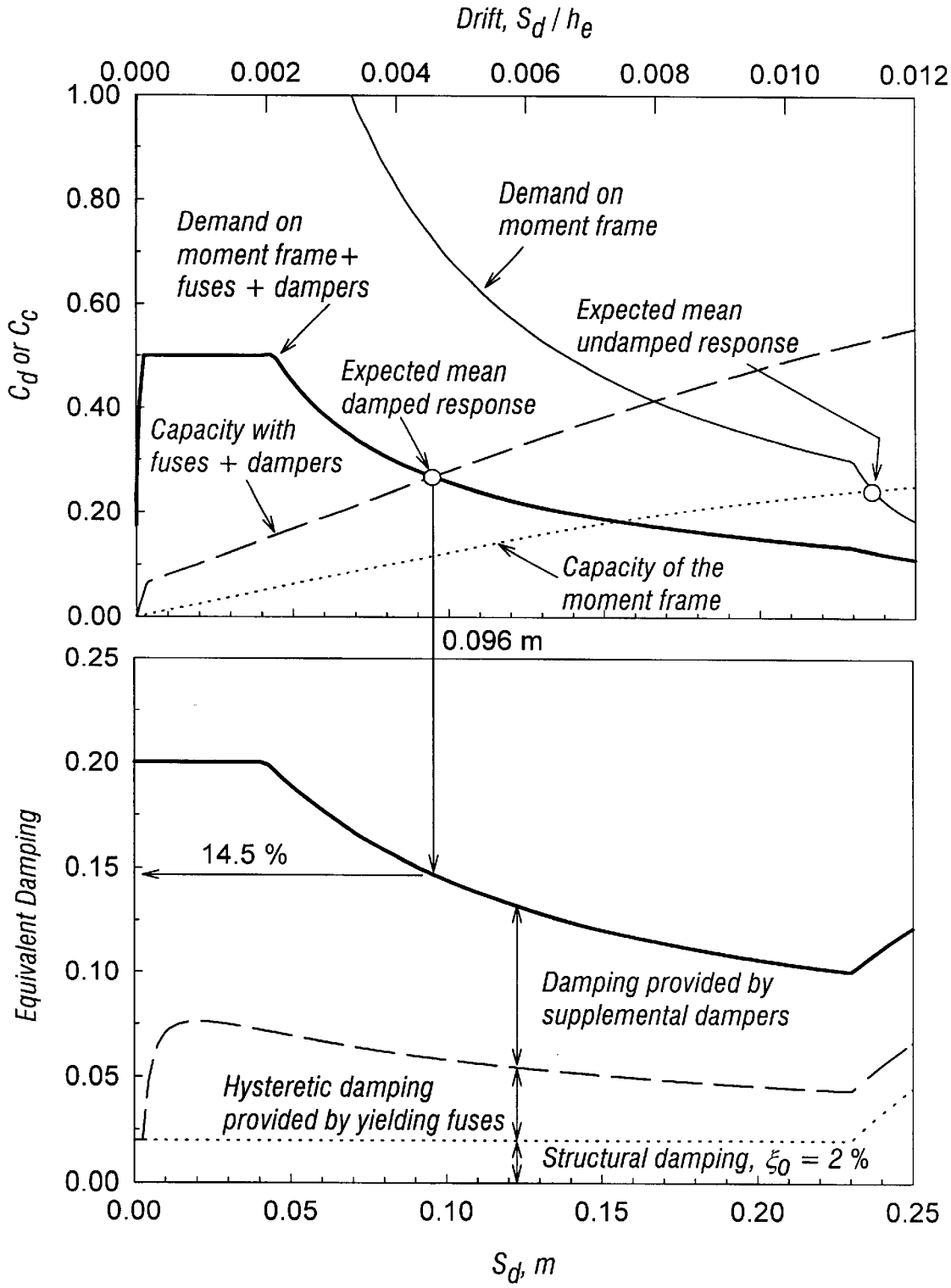
FIG. 22 is a graph similar to that of FIG. 13 illustrating preliminary design parameters for a supplemental damping system in the example retrofit.

The effect of the supplemental system-tendon system on the capacity of the example structure is evaluated after the above design detailing. A reduced demand curve that accounts for the added damping due to fuse-bar yielding and dampers obtained for one of the configurations is shown in FIG. 22. As can be seen from the figure, design performance point is defined as where the reduced demand curve intersects the corresponding capacity curve. Accordingly, design roof displacement under MAE ground motions is 0.129 m for the tendon-fuse+damper case. It must be noted however, that the performance point is considered to be an average response. Hence, variations should be expected due to uncertainties involved in the design spectral representation of the ground motion demand and possible higher mode spill-over dynamic effects.

Figure 23:
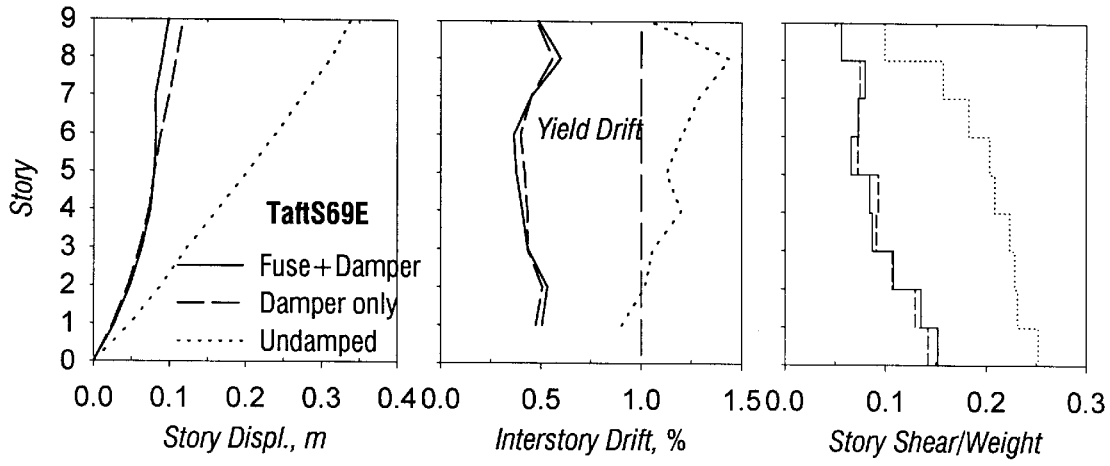
FIG. 23 is a graph illustrating response envelopes for the example structure under maximum assumed earthquake (MAE) ground motions.
Figure 24:
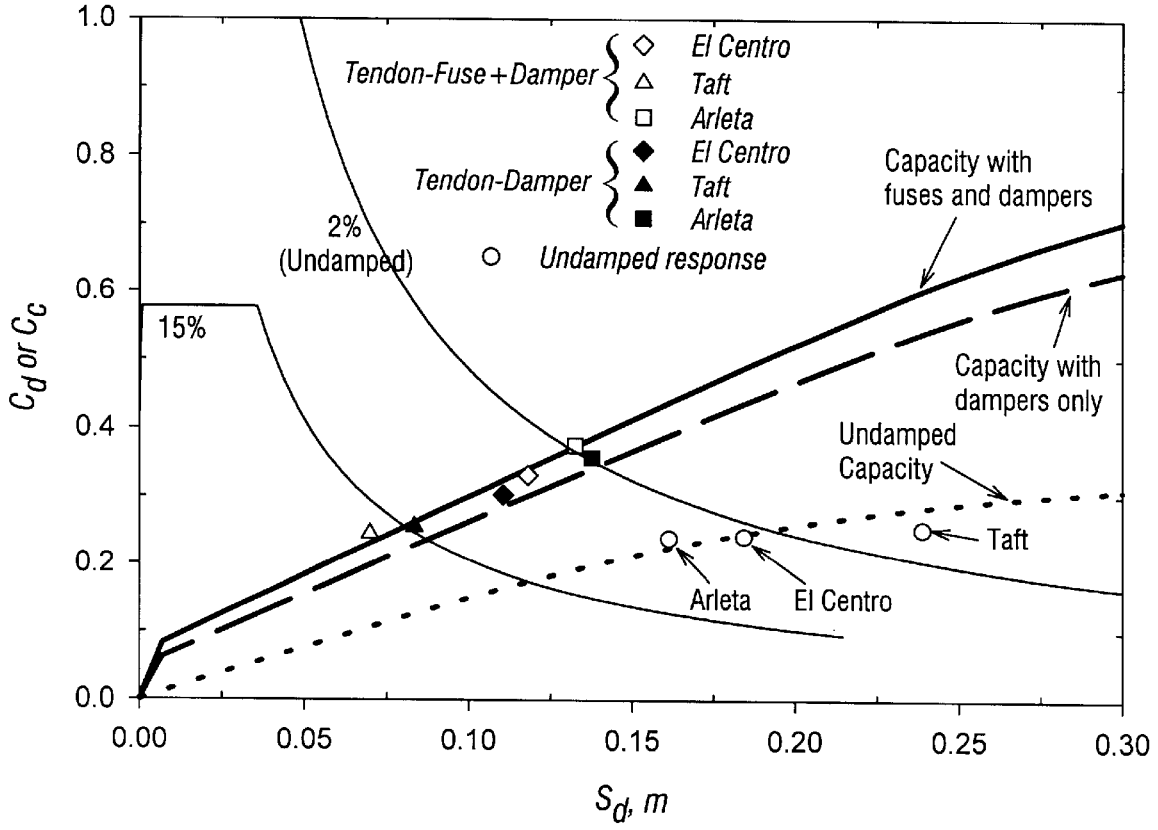
FIG. 24 is a graph illustrating performance characteristics of the tendon systems incorporated in the example structure under MAE ground motions.

Overall response of the example nine-story steel structure is plotted in FIG. 23 for scaled Taft S69E (MAE) ground motion. A general overview of the undamped response (especially under El Centro) reveals the fact that the structural system was well designed according to the governing seismic code requirements. However, a considerable number of plastic hinges (although generally less than 0.5% radian) in the undamped structure form under the scaled Taft ground motion. Moreover, it can be seen from FIG. 23 that unacceptably large interstory drifts may be expected in the upper four stories. Also plotted in FIG. 23 are the maximum response envelopes for the damper tendon and fuse+damper tendon designs in comparison with the undamped response. In general, both designs reduced the maximum response consistently below the elastic limits, hence the structure remained elastic at all times. In compliance with the design performance objective, a near uniform interstory drift profile is obtained. Interstory column shear is reduced and the target design roof displacement is attained. Performance points of the structure are plotted in FIG. 24 on corresponding modified (for the presence of supplemental system) pushover curves along with the 20% damped demand curves of the ground motions. Variations in the response are attributed to the ground motion variability.

Figure 25:
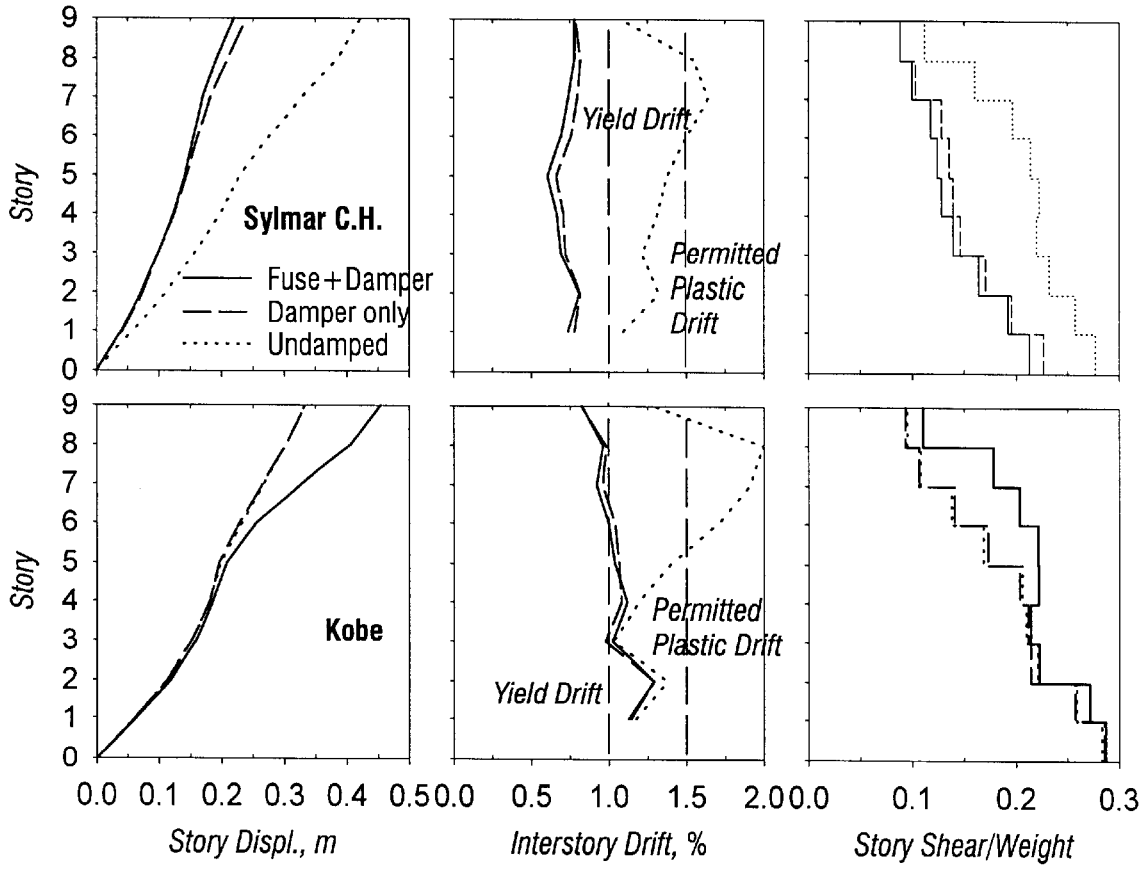
FIG. 25 is a graph illustrating response envelopes for the example structure under maximum considered earthquake (MCE) ground motions.
Figure 26:
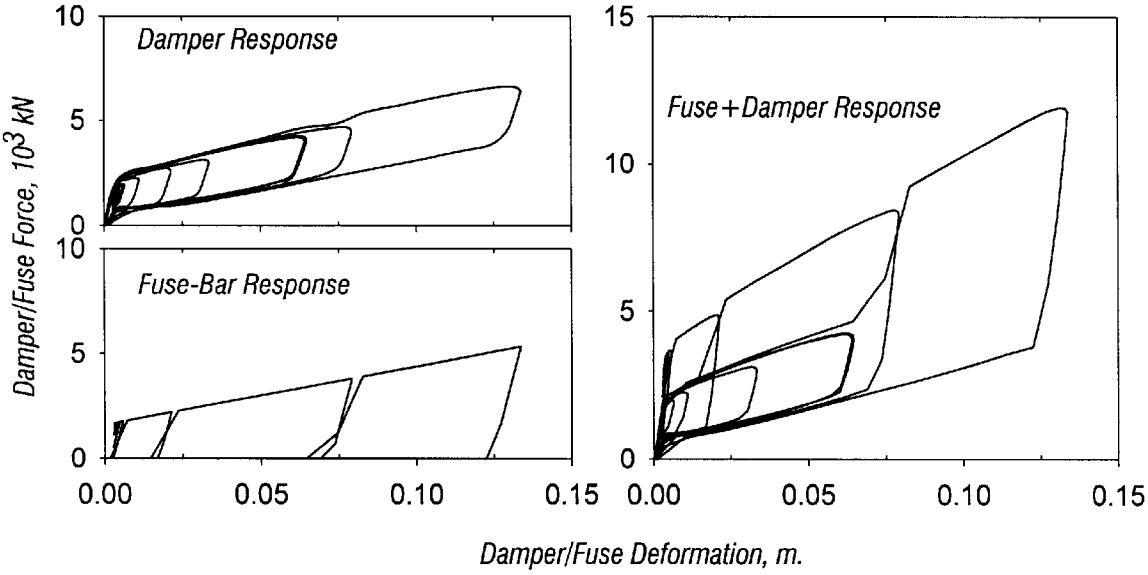
FIG. 26 is a graph illustrating force-deformation response for a supplemental damping system incorporated in the example structure.

As part of the verification phase, the example structure was analyzed under MCE ground motions. Maximum response envelopes for the damper tendon and fuse+damper tendon designs are plotted in FIG. 25 in comparison with the undamped response for Kobe ground motion. Although significant yielding can be observed from the figure, the plastic hinge rotations stayed below 0.5% radians at all times. The overall difference between the undamped frame and the damped frame is apparent. While inelastic response is occurring in the damped frame, it is both of lower magnitude and less widespread. A sample fuse and damper response is shown in FIG. 26 for Sylmar ground motions scaled to PGA=0.6 g.

A straightforward preliminary design methodology is introduced as part of a complete design process. Although this design methodology can be generalized for other supplemental systems, the emphasis is given to the systems that are of nonlinear-viscous ($\alpha<1$) nature with or without prestress. The overall design methodology follows the basic principles of capacity design approach but has improvements, especially the preliminary design phase. The proposed preliminary design phase yields a supplemental system capacity for the equivalent single-degree-of-freedom (SDOF) system which is then adopted in a design strategy.

It is evident from the analysis results summarized in the previous paragraphs that the proposed preliminary design methodology is sufficiently accurate in light of the randomness of ground motion spectra. Moreover, it is suitable for most of the design and retrofit alternatives with supplemental energy dissipating systems. However, since the overall response may be affected by the variations in ground motion characteristics as well as higher mode effects, a comprehensive verification is generally needed to verify the adequacy of the design.

Prestress tendon solutions (damper–tendon and fuse+damper–tendon) characteristically modify the structural dynamic properties (dominant mode shape etc.). Since the determination and detailing of the tendon layout is initially based on the undamped response of the structure, balanced inertial loads on the damped structure are in fact different than those initially considered. The expected damping forces (hence damping) cannot be fully attained, merely due to fact that the inertial loads that the design is based on, are not in fact balanced effectively. Consequently, although it may not be possible to design a true optimal layout, an iterative procedure should be adopted which would converge to an acceptable layout that is "near optimum." The target design (performance objective) can be more efficiently attained with a fuse+damper combined supplemental system. The maximum response of the structure is reduced below the desired limits with both designs. However, it must be noted that the proposed fuse+damper system might be especially effective under pulse-type ground motions. Moreover, it provides high initial stiffness and therefore is desirable under service conditions (wind loads etc).

What is claimed is:

1. In a structure having two or more levels and two or more opposite sides, an improvement for mitigating a load imposing an overturning bending moment distribution upon said structure, said improvement comprising:

a tensioned tendon having a first end and a second end, said first end being fixedly connected to one of said levels of said structure proximate one side of said structure and said second end being fixedly secured to another of said levels of said structure proximate another side of said structure opposite said one side;

wherein said tendon is oriented in space between said first end and said second end along a predetermined curve selected to provide optimum reaction to said load.

2. The improvement according to claim 1, further including a supplemental system for connecting said second end of said tendon to said another level.

3. In a structure having two or more levels and two or more opposite sides, an improvement for mitigating a load imposing an overturning bending moment distribution upon said structure, said improvement comprising:

a tensioned tendon having a first end and a second end, said first end being fixedly connected to one of said levels of said structure proximate one side of said structure and said second end being fixedly secured to another of said levels of said structure proximate another side of said structure opposite said one side, said tendon being oriented in space between said first end and said second end along a predetermined curve selected to provide optimum reaction to said load; and a supplemental system for connecting said second end of said tendon to said another level, wherein said supplemental system comprises a mechanical energy dissipating device and a sacrificially yielding fuse element arranged in parallel with said mechanical energy dissipating device, said mechanical energy dissipating device and said fuse element each being connected in series with said tendon between said tendon and said another level.

4. In a structure having two or more levels and two or more opposite sides, an improvement for mitigating a load imposing an overturning bending moment distribution upon said structure, said improvement comprising:

a tensioned tendon having a first end and a second end, said first end being fixedly connected to one of said levels of said structure proximate one side of said structure and said second end being fixedly secured to another of said levels of said structure proximate another side of said structure opposite said one side, said tendon being oriented in space between said first end and said second end along a predetermined curve selected to provide optimum reaction to said load; and a supplemental system for connecting said second end of said tendon to said another level, wherein said supplemental system comprises a mechanical energy dissipating device connected in series with said tendon between said tendon and said another level.

5. In a structure having two or more levels and two or more opposite sides, an improvement for mitigating a load imposing an overturning bending moment distribution upon said structure, said improvement comprising:

a tensioned tendon having a first end and a second end, said first end being fixedly connected to one of said levels of said structure proximate one side of said structure and said second end being fixedly secured to another of said levels of said structure proximate another side of said structure opposite said one side, said tendon being oriented in space between said first end and said second end along a predetermined curve selected to provide optimum reaction to said load; and a supplemental system for connecting said second end of said tendon to said another level, wherein said supplemental system comprises a sacrificially yielding fuse element connected in series with said tendon between said tendon and said another level.

6. The improvement according to claim 3, wherein said one of said levels is a roof level of said structure and said another of said levels is a foundation level of said structure.

7. The improvement according to claim 4, wherein said one of said levels is a roof level of said structure and said another of said levels is a foundation level of said structure.

8. The improvement according to claim 5, wherein said one of said levels is a roof level of said structure and said another of said levels is a foundation level of said structure.

9. The improvement according to claim 1, wherein said predetermined curve is selected to be approximately proportional to said overturning bending moment distribution.

10. The improvement according to claim 9, wherein said tendon is arranged to pass slidably through each structural level between said one level and said another level approximately at a coordinate corresponding to a point on said predetermined curve.

* * * * *